US009009867B2

(12) United States Patent
Bowen et al.

(10) Patent No.: US 9,009,867 B2
(45) **Date of Patent: *Apr. 21, 2015**

(54) SYSTEMS AND METHODS FOR PROVIDING APPAREL HAVING AN INTERNAL FLUID CONTAINER

(71) Applicant: Baxbo, LLC, Logan, UT (US)

(72) Inventors: Thomas K. Bowen, Pleasant Grove, UT (US); Shawn W. Baxter, Logan, UT (US)

(73) Assignee: Baxbo, LLC, Logan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/794,379

(22) Filed: Mar. 11, 2013

(65) Prior Publication Data

US 2013/0247271 A1 Sep. 26, 2013

Related U.S. Application Data

(63) Continuation-in-part of application No. 12/961,317, filed on Dec. 6, 2010, now Pat. No. 8,393,013, which is a continuation of application No. 12/102,788, filed on Apr. 14, 2008, now Pat. No. 7,845,019.

(60) Provisional application No. 60/923,279, filed on Apr. 13, 2007.

(51) Int. Cl.

| | |
|---|---|
| ***A41D 25/00*** | (2006.01) |
| ***A41D 1/00*** | (2006.01) |
| ***A47G 9/10*** | (2006.01) |
| ***A41D 15/04*** | (2006.01) |
| ***A45F 3/20*** | (2006.01) |
| ***A41D 23/00*** | (2006.01) |
| *A45F 3/16* | (2006.01) |

(52) U.S. Cl.

CPC *A41D 1/00* (2013.01); *A41D 25/00* (2013.01); *A41D 25/001* (2013.01); *A47G 9/1027* (2013.01); *A41D 15/04* (2013.01); *A45F 3/20* (2013.01); *A45F 2003/166* (2013.01); *A41D 23/00* (2013.01)

(58) Field of Classification Search

USPC ..... 2/69, 102, 170, 171, 144, 456, 94, 247, 2/108, 269, DIG. 3

See application file for complete search history.

(56) References Cited

U.S. PATENT DOCUMENTS

| | | | | |
|---|---|---|---|---|
| 3,676,879 | A * | 7/1972 | Irie | 2/202 |
| 4,834,688 | A * | 5/1989 | Jones | 446/28 |
| 5,781,936 | A * | 7/1998 | Alaloof | 2/456 |
| 5,860,162 | A * | 1/1999 | Love | 2/2.14 |
| 7,392,549 | B1 * | 7/2008 | Barber | 2/86 |
| 7,707,650 | B2 * | 5/2010 | Sides | 2/69 |

(Continued)

*Primary Examiner* — Tejash Patel

(74) *Attorney, Agent, or Firm* — David B. Tingey; Bryant J. Keller; Kirton McConkie

(57) ABSTRACT

This disclosure relates to apparel and/or clothing accessories containing a fluid container. In particular, disclosed are systems and methods for providing apparel and/or accessories that selectively contain a fluid container that can be filled with a drinkable liquid. The apparel item may include any clothing or object that is adapted to be worn by a person, such as a necktie. In some cases, the apparel item is made to receive and retain a liquid-tight container within an internal compartment of the apparel. A flexible tube is connected to the container and runs from within the apparel item out, so that a wearer can drink fluid from the container through the flexible tube. Additionally, in some cases, when inflated, the container provides a pillow or cushion.

20 Claims, 9 Drawing Sheets

(56) References Cited

U.S. PATENT DOCUMENTS 7,841,344 B2 * 11/2010 Schlosser ..... 128/205.22
7,845,019 B2 * 12/2010 Bowen et al. ..... 2/144
8,065,745 B2 * 11/2011 Huell ..... 2/64
8,356,364 B2 * 1/2013 Sides ..... 2/69
8,393,013 B2 * 3/2013 Bowen et al. ..... 2/69
8,398,574 B1 * 3/2013 Wiens ..... 602/68

* cited by examiner

SYSTEMS AND METHODS FOR PROVIDING APPAREL HAVING AN INTERNAL FLUID CONTAINER

RELATED APPLICATIONS

This is a continuation-in-part of U.S. patent application Ser. No. 12/961,317, entitled "SYSTEMS AND METHODS FOR PROVIDING INFLATABLE APPAREL," filed Dec. 6, 2010, which is a continuation application of U.S. patent application Ser. No. 12/102,788, entitled "SYSTEMS AND METHODS FOR PROVIDING INFLATABLE APPAREL," filed Apr. 14, 2008 (now U.S. Pat. No. 7,845,019), which claims priority to U.S. Provisional Patent Application Ser. No. 60/923,279, entitled "SYSTEMS AND METHODS FOR PROVIDING AN INFLATABLE NECKTIE," filed Apr. 13, 2007. All of the applications are incorporated herein by reference.

BACKGROUND OF THE INVENTION

1. Field of the Invention

This disclosure relates to apparel and/or clothing accessories containing a fluid container. In particular, disclosed are systems and methods for providing apparel and/or accessories that selectively contain a fluid container that can be filled with a fluid, such as a drinkable liquid.

2. Background

Liquids are necessary to sustain life. However, it is not always convenient to carry liquids while traveling, working, commuting, attending meetings, or attending social events. Accordingly, it would be advantageous to augment, replace, or provide new methods of carrying liquids.

SUMMARY

This disclosure relates to apparel and/or clothing accessories containing a fluid container. In particular, disclosed is a systems and methods for providing apparel and/or accessories that selectively contain a fluid container that can be filled with a fluid, such as a drinkable liquid.

In one aspect of the invention, an item of apparel includes a container, the container being fluid-tight; an apparel item comprising an internal compartment configured to receive and retain the container; and a tube (e.g., a flexible or rigid tube) connected to the container and running from within the apparel item out of the apparel item.

Implementations may include one or more of the following features. In some implementations, the apparel item includes a necktie. In some such implementations, the necktie may include a wide end and a narrow end, and the container may be disposed within the internal compartment within the wide end. The tube (e.g., the flexible tube) may run from the container to the narrow end of the necktie. The internal compartment may further include a retaining mechanism that is adapted to selectively retain the container in the necktie. A first end of the flexible tube may be connected to the container and a second end of the flexible tube may have a valve to selectively seal the second end. The valve may include a valve opening and the valve opening may be a slit. The valve may be compressible. The container may further include an opening that is selectively opened and closed. The container may be rigid or flexible, and may be a flexible bladder. The apparel item may be any type of an ascot; a scarf; a turtle-neck collar; a jacket lapel; a shirt collar; a coat collar; a coat hood; a jacket hood; a hoodie; a stocking cap; a hat; a headband; a wrist band; a shirt cuff; a brazier; an article of underwear (e.g., a pair of briefs, panties, boxers, etc.); a wallet; a cravat; a bandana; a sleeve; a back of a shirt, jacket, coat, or other clothing; a seat or pocket of a pair of pants, shorts, capris', etc.; or a purse.

In another aspect, the apparel item (e.g., neckwear) includes a container, the container being fluid-tight; an internal compartment within the neckwear configured to receive and retain the container; and a flexible tube connected to the container and running from within the neckwear item out of the neckwear.

Implementations may include one or more of the following features. The flexible tube may run from the container to an end of the neckwear. A first end of the flexible tube may be connected to the container and a second end of the flexible tube may have a valve to selectively seal the second end. In some implementations, the flexible tube is shortened so that a substantial portion of the container's weight is supported by the tube, as opposed to an internal compartment (discussed below). The neckwear may be a necktie having a wide end and a narrow end, and the internal compartment may be within the wide end and the flexible tube runs from the container to the narrow end of the necktie.

In another aspect, a method for making a fluid-bearing necktie, the method comprising: providing a fluid-tight container; providing a necktie having an internal compartment configured to receive the container; and providing a flexible tube having a first end connected to the container.

Implementations may include one or more of the following features. The method may further comprise inserting the container into the internal compartment and running the second end of the flexible tube through and out the apparel item (e.g., necktie). The method may further comprise providing a valve on the second end of the flexible drink tube.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

This disclosure relates to apparel and/or clothing accessories containing a fluid container. In particular, disclosed are systems and methods for providing apparel and/or accessories that selectively contain a fluid container that can be filled with a fluid, such as a drinkable fluid.

Figure 1A:
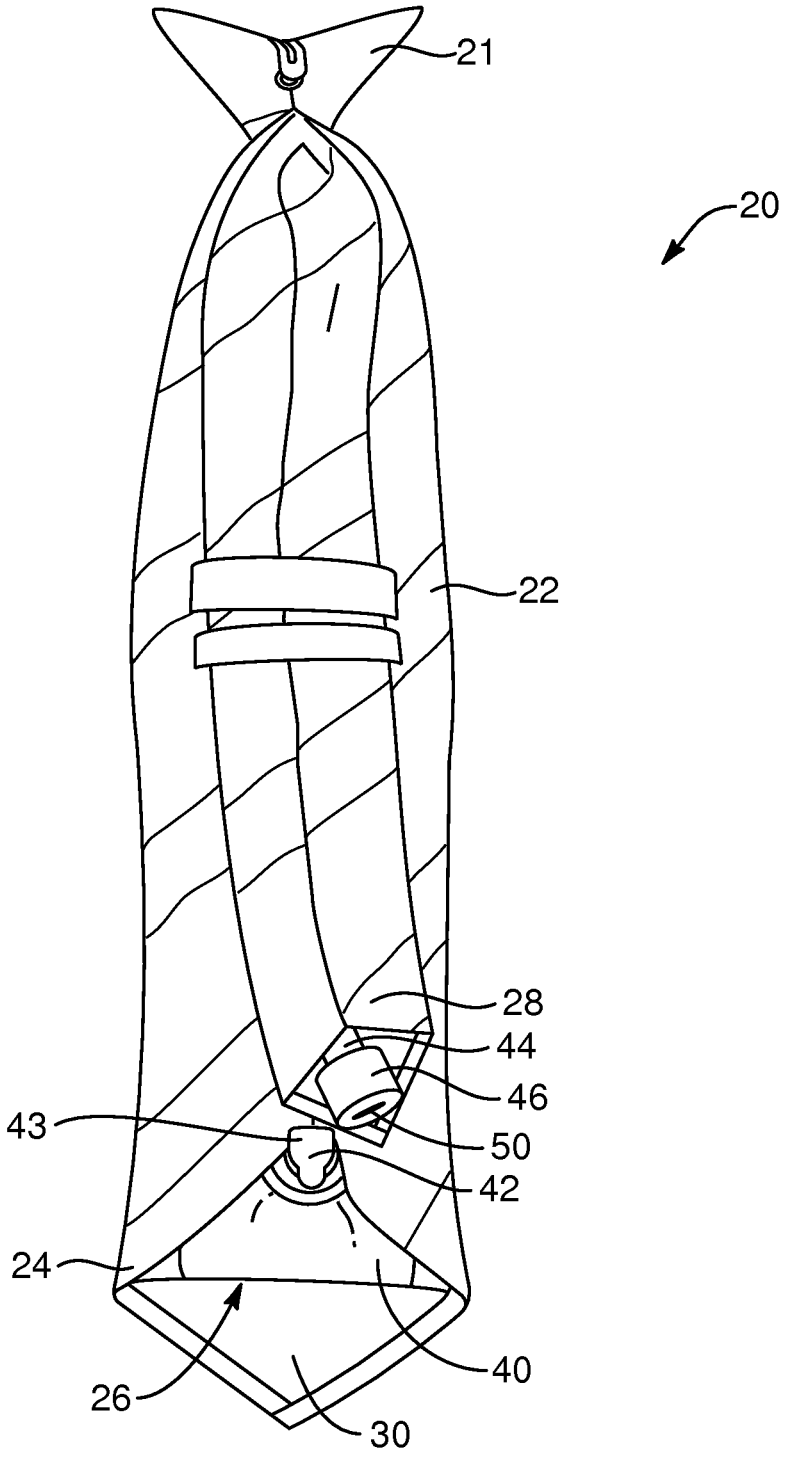
FIG. 1A illustrates a back view of a representative necktie in accordance with an embodiment of the present invention.

Although the described item of apparel can comprise any component that allows it to be worn and contain fluid (e.g., water, air, juice, soda, a beverage, an alcoholic drink, and/or any other suitable fluid) therein, FIG. 1A shows some embodiments where the apparel item 20 comprises a necktie 22 having a container 40 disposed within. In some embodiments, the container 40 is disposed within the apparel item and is used for containing a fluid (e.g., a drinkable liquid) and/or for being inflated, such that the apparel item functions as a pillow.

In some configurations, the container 40 is rigid or semi-rigid and functions primarily as a container for fluids (e.g., a drinkable liquid). In other configurations, the container 40 is semi-flexible, or flexible, as with a flexible bladder. In these latter configurations, the container 40 can be used both as a fluid container as well as to be inflated to act as a pillow or other cushioning device, as described in U.S. patent application Ser. No. 12/102,780 (now U.S. Pat. No. 7,845,019), referenced above and incorporated herein.

Figure 1B:
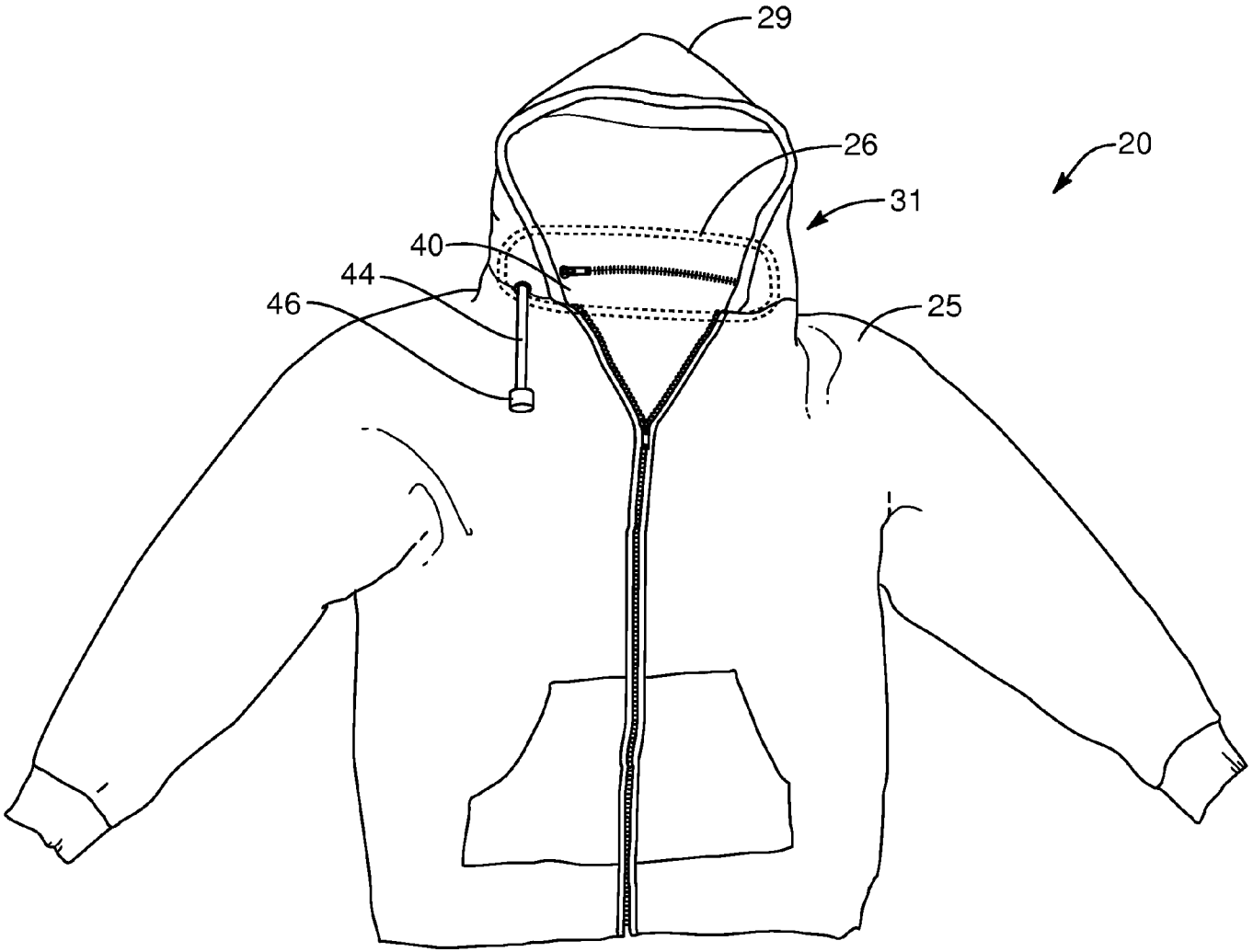
FIG. 1B illustrates a front view of a representative embodiment of a hooded apparel item comprising a container.
Figure 1C:
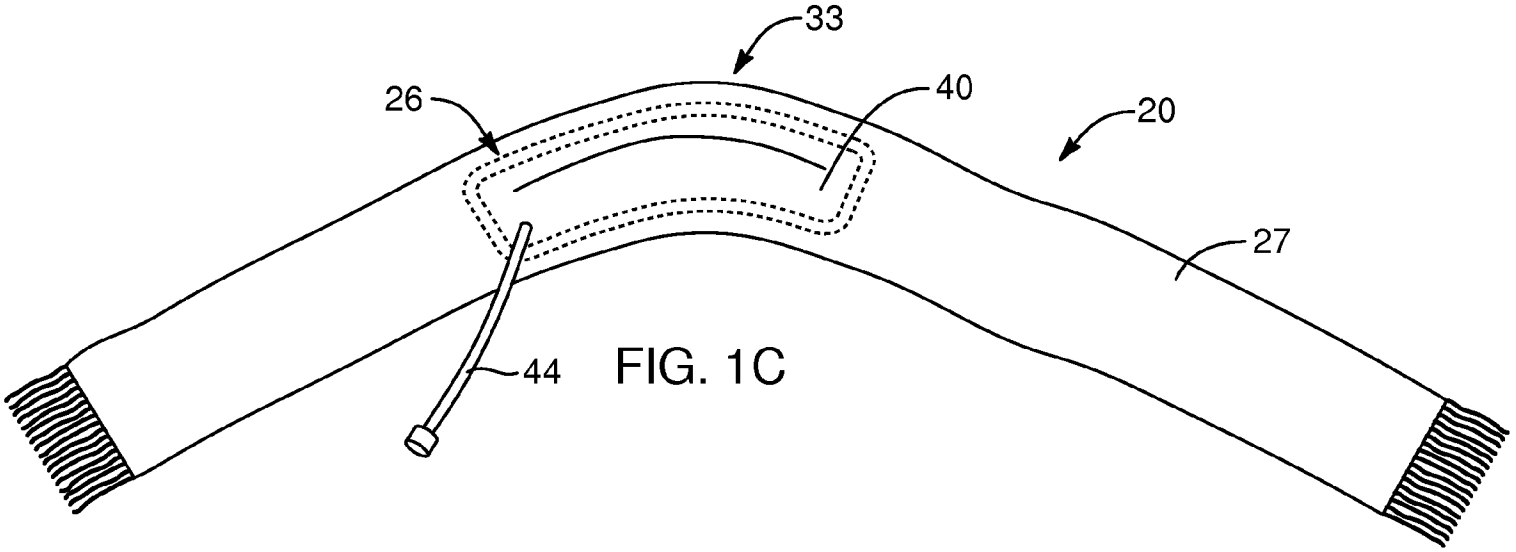
FIGS. 1C-1D each illustrate a front view of a representative embodiment of a scarf comprising a container.
Figure 1D:
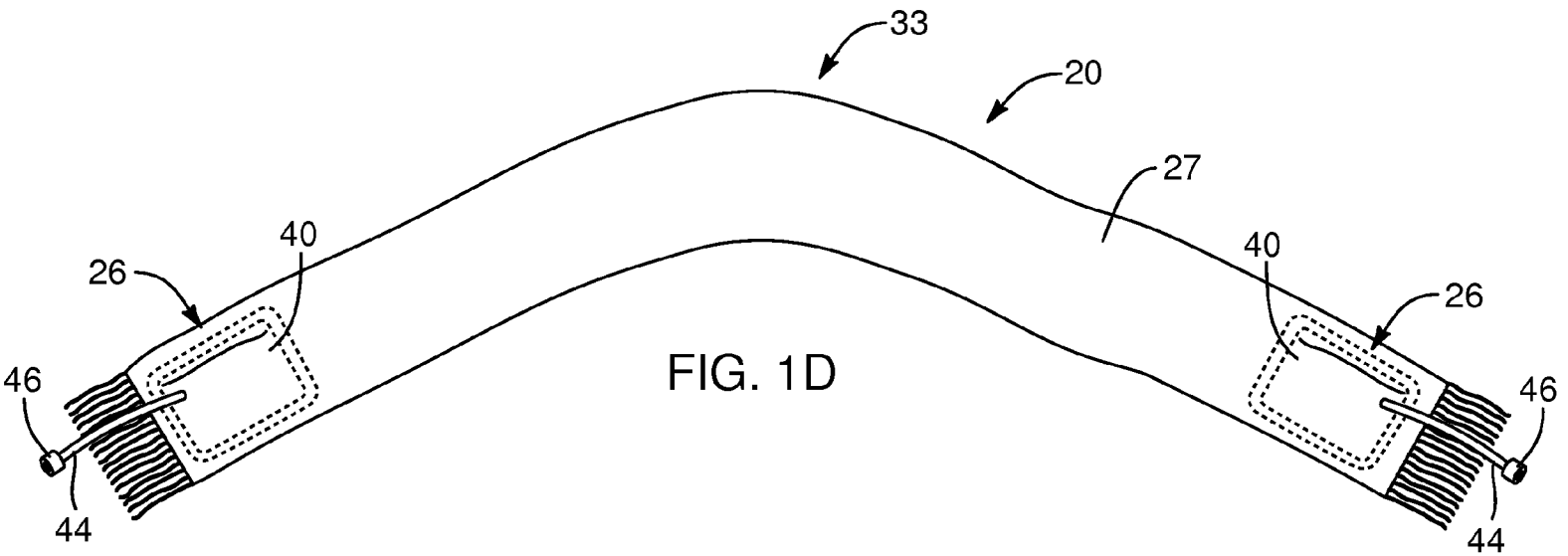
Figure 2:
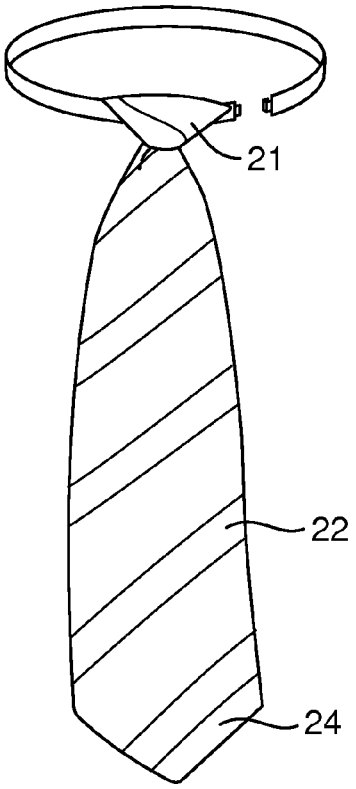
FIG. 2 illustrates a front view of a representative necktie in accordance with an embodiment of the present invention.

With reference to the apparel item 20, the apparel item may include any clothing item, accessory, or object that is adapted to be worn by a person and that can retain the weight of some fluid within a container 40. Some non-limiting examples of such apparel items include any suitable type of neckties, ascots, scarves, beagle scarves, turtle-neck collars, jacket lapels, shirt and coat collars, hooded apparel items (e.g., hooded coats, hooded jackets, hoodies, and other apparel items that have a hood that is integrally attached to, or selectively attachable and detachable from, such apparel items), upper torso garments (e.g., shirts, coats, and other apparel worn on a person's torso), lower torso garments (e.g., belts, pants, and other apparel that is worn at least partially below a person's waist), stocking caps, hats, headbands, wristbands, shirt cuffs, braziers, underwear, wallets, purses, bandanas, dew-rags, cravats, boas, and any other apparel that can be selectively inflatable for use as a pillow or filled with a fluid. Accordingly, in some instances, the apparel item comprises neckwear, or an article of clothing worn about the neck, such as a necktie, cravat, bow tie (including, without limitation, a prettied bowtie), scarf, shawl, boa, bandana, etc. In one non-limiting example, FIG. 1A shows a representative embodiment in which the apparel item 20 comprises a necktie 22. In another example, FIG. 1B shows a representative embodiment in which the apparel item 20 comprises a jacket, coat, sweat shirt or other hooded article of apparel 25 (e.g., a hoodie). In still another example, FIGS. 1C-1D show representative embodiments in which the apparel item 20 comprises a scarf 27.

In some embodiments, the apparel item 20 comprises a necktie 22. In such embodiments, the necktie 22 can serve dual functions, namely containing fluid and forming part of an outfit. The necktie 22 can comprise any known or type of necktie, including a four-in-hand necktie, a six-fold tie, a seven-fold tie, a zipper tie, a clip-on tie, a pre-tied tie (e.g., a necktie, bowtie, etc.) with a neckband, and the like. By way of illustration, FIGS. 1A and 2-3B depict embodiments of neckties 22.

Referring specifically to necktie 22, the necktie can comprise any suitable features, structures, characteristics, or components that allow it to be worn around a person's neck and to contain the container 40. Indeed, in some configurations (as shown in FIG. 1A, the necktie 22 has a common style with a wide end 24 that is generally worn in front, and a narrow end 28 that is generally worn in back of the wide end 24. In some instances, the container 40 is included within the wide end 24 or the narrow end 28 of the necktie 22. In some configurations, these two ends optionally comprise an outer material and optionally comprise an inner lining. The outer material may be made of any material suitable for use in a necktie, such as silk, polyester (i.e., microfiber), cotton, wool, and/or another suitable material. In some embodiments, the container 40 is disposed within the outer material, while in other embodiments, it is disposed within the inner material, or between the inner and the outer material.

In some embodiments, the necktie 22 (or other apparel item) includes an internal compartment (such as a pocket) 26 that is configured to receive the container 40 therein. In such embodiments, the internal compartment 26 can comprise any component that allows the apparel item (e.g., necktie) to perform the described functions. For example, the internal compartment 26 can include an enclosure, a cavity, a covering, a pocket, an internal space, a zipper, a button and button hole, and/or chamber that are configured to receive the container 40. By way of illustration, FIG. 1A shows an embodiment where a portion of the necktie 22 comprises an internal compartment 26 that houses the container 40 within a pocket extending from an opening in the wide end 24 upwards into the wide end 24.

In instances where the apparel item 20 comprises another item of clothing, such as a scarf, bra, collar, hood, shirt, pair of pants, or a hat, the internal compartment can be disposed in any portion of that item that is capable of containing the container 40 therein. For instance, while the container can be disposed in any suitable location within a hood (or hat) (e.g., so as to be in a location such that when warn with the hood over a user's head, the container is disposed (at least partially) behind the user's head, on the sides of the user's head, over the user's forehead, over or around the user's ears, near a portion of the user's neck, and/or any other suitable location), FIG. 1B shows an embodiment in which the hood 29 comprises an internal compartment 26 that is configured to hold the container 40 at or near a neck portion 31 of the hood 29. In another illustration, while the container can be disposed in any suitable location within a scarf (e.g., so as to be positioned in the middle of the scarf, along a length of the scarf, near one or both ends of the scarf, and/or any other suitable position), FIG. 1C shows an embodiment in which the scarf 33 comprises an internal compartment 26 that is configured to hold the container 40 and that is centrally disposed along a length of the scarf 33, while FIG. 1D shows an embodiment in which the container 40 is disposed at both ends of the scarf 33.

The internal compartment 26 can be made in any manner that allows the space to house and retain the container 40. For instance, the internal compartment can be lined with a rigid, semi-rigid, semi-flexible, or flexible pocket that is configured to retain the container 40 therein. In some embodiments, this pocket lining is waterproof.

Figure 3A:
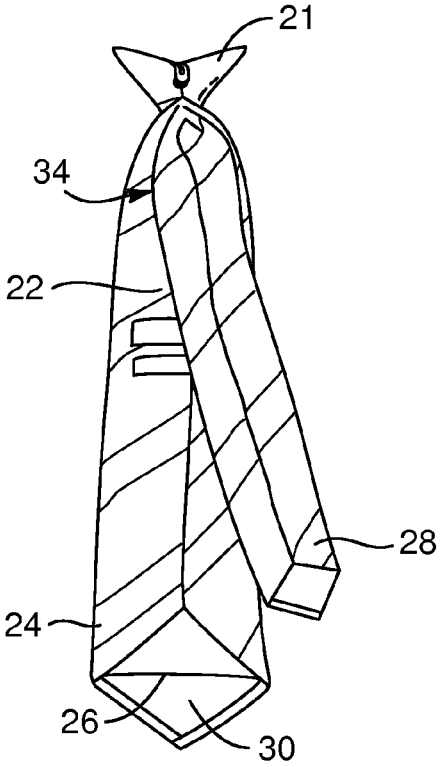
FIGS. 3A-3B each illustrate a back view of representative necktie that is configured to receive a container in accordance with an embodiment of the present invention.
Figure 3B:
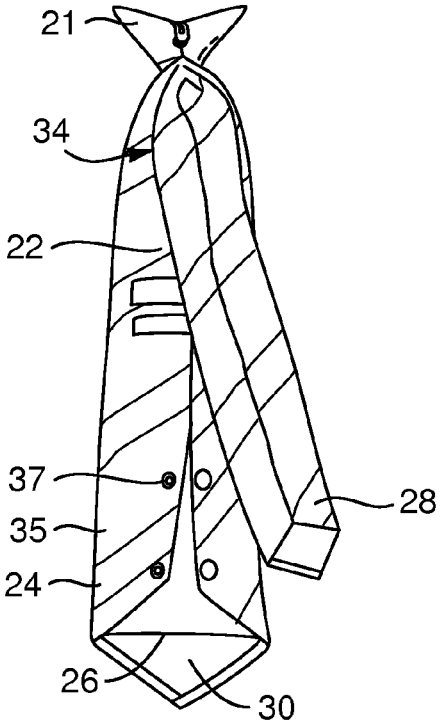

Referring back to FIG. 1A, in some embodiments, the necktie 22 (or other apparel item 20) includes one or more retaining mechanisms that act to selectively or permanently retain the container 40 within the internal compartment 26 of the necktie 22 (or other apparel item). Any component that acts to retain the container 40 in the necktie 22 (or other item) can act as the retaining mechanism. Some non-limiting examples of retaining mechanisms that permanently retain the container within the necktie can include a mechanical fastener (e.g., stitching, rivets, etc.) or a chemical fastener (e.g., an adhesive). Similarly, some examples of retaining mechanisms that selectively and/or permanently retain the container 40 in the necktie can include a flap, a hook and loop fastener, a rod, a snap, a button and corresponding button hole, a frictional engagement, a loop, a clip, a zipper, one or more magnets, and/or any other component adapted to selectively retain the container 40 in the necktie 22. In one example, FIG. 3A shows an embodiment in which the retaining mechanism comprises a flap 30 that is disposed on the backside of the wide end 24 of the necktie 22. In some embodiments, the flap 30 acts as a sling to support the bottom end of the container 40 and/or to retain it within the necktie 22. In another example, FIG. 3B shows the backside 35 of the wide end 24 of the necktie 22 comprises a fastening mechanism, such as one or more magnets, snaps, hook and loop fasteners, etc., that allows the backside of the tie to be selectively opened and closed. Specifically, FIG. 3B shows an embodiment in which the fastening mechanism comprises multiple snaps 37.

Furthermore, additional retaining mechanisms are optionally disposed on or within the necktie 22 to support the top portion of the container 40 to prevent it from slumping toward the bottom of the wide end 24 of the necktie 22. These can include clips, magnets, hook and loop fasteners, and/or various other fasteners. In some embodiments, however, a flexible and/or rigid/semi-rigid tubing 44 that is connected to and supports the container 40 is shortened so that it supports a substantial portion of the container's weight. While this can be done in any suitable manner, in some embodiments, a portion of the tubing is secured to (e.g., via a strap, stitching, mechanical connector (such as a snap, hook and loop fastener, etc.), adhesive, by being embedded in or passing through) a portion of apparel item (e.g., the knot portion 21 of the necktie 22) such that a shortened portion of the tubing extends to and supports the container so that only a portion of the container's weight (if any) is supported by the internal compartment 26.

With reference now to the container 40, as shown in FIG. 1A, the container 40 can be placed within the apparel item 20 and can selectively store a fluid. Such a container 40 can be substantially enclosed to hold liquids or other fluids therein without leaking. Non-limiting examples of the container 40 include one or more rigid plastic containers, rigid flasks, flexible bladders, collapsible plastic containers, and/or one or more other such containers that can hold fluids therein. Accordingly, in some embodiments, the container 40 is rigid, while in other embodiments, the container 40 is flexible or semi-flexible. By way of illustration, FIGS. 4 and 5, which are described below, show some embodiments where the container 40 is represented as a bladder. The container 40 can be formed to contain any fluid (e.g., any liquid that is suitable to drink). For example, the container 40 can be formed of one or more: metals, plastics, polymers (e.g., polyethylene terephthalate, polyethylene, polycarbonate, biaxially-oriented polyethylene terephthalate, polyester, polyvinyl chloride, etc.), types of vinyl, rubberized fabrics (e.g., rubberized canvas), rubbers, and/or other fluid-tight and/or liquid-tight materials. Moreover, the container 40 can comprise multiple materials and/or layers of materials.

In some embodiments, the container 40 is configured to have insulating properties that help maintain a desired temperature of the fluid. While this can be accomplished in any suitable manner, in some embodiments, the container comprises and/or is at least partially enveloped in an insulating material. Some examples of such materials include, but are not limited to, foam (e.g., closed-cell foam, polyethylene foam, neoprene, sponge rubber, thin-wall foam, foam-foil insulation, thin-foam lamination, silica-nano foam, etc.), fiberglass, a material with a reflective surface (e.g., thin reflective insulation, aluminized fabric/film, etc.), polyester, a batting, and/or any other suitable material.

In some configurations, the container 40 is shaped or sized to allow the container 40 to fill at least a portion of the apparel item (e.g., necktie 22) without being excessively noticeable. Indeed, in some embodiments, the container 40 is shaped and sized to extend less than or equal to one half the length of the wide end 24 of the necktie 22. In other embodiments, the container 40 is shaped and sized to extend less than or equal to one third the length of the wide end 24 of the necktie 22. In other embodiments, the container 40 is shaped and sized to extend less or more than one half the length of the wide end 24 of the necktie 22.

Figure 5:
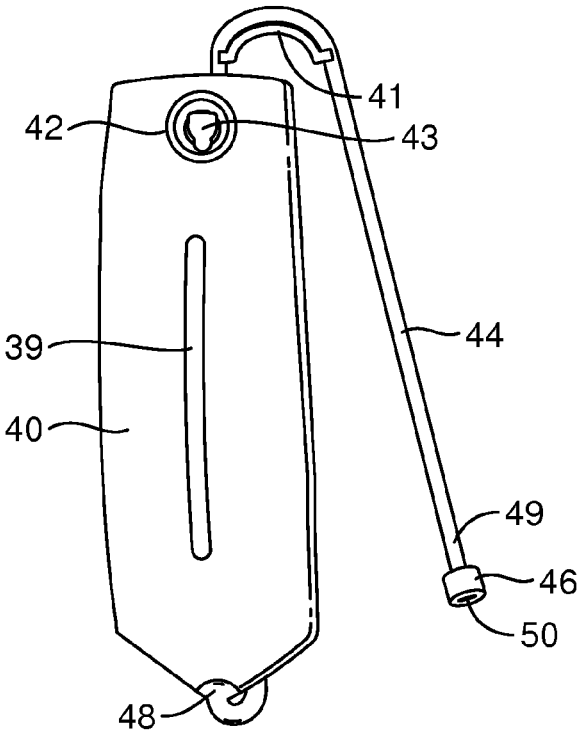
FIG. 5 illustrates a view of a representative container in accordance with an embodiment of the present invention.

In some embodiments in which the container 40 comprises a flexible material, the container is configured to remain relatively thin when it is filled so as to not be excessively noticeable within the apparel item 20. While this can be accomplished in any suitable manner, in some embodiments, portions of the container (e.g., a front and back portion) are joined together (e.g., via heat bonding; high frequency welding; one or more adhesives, mechanical fasteners, and/or any other suitable manner) that reduces the extent to which the container can expand. By way of illustration, FIG. 5 shows an embodiment in which the container 40 comprises one or more welds 39 that help the container 40 maintain a desired shape when filled.

In some embodiments, the container 40 comprises an opening 42 that allows the container to be selectively filled and emptied. The opening 42 can be selectively closed and sealed after it is filled or emptied to prevent leakage of fluid within the apparel item. Non-limiting examples of such openings 42 include a plug-in-hole valve 43 (as shown), a threaded opening 42 (not shown) with a cap that seals the threaded opening, etc. As shown in FIG. 5, the opening 42 is a plug-in-hole valve 43 that may be squeezed in order to allow fluid to escape from the container 40. In some embodiments, the container 40 does not have an opening, but is filled through a tube (e.g., a flexible tune 44, a rigid tube, and or a semi-rigid tube).

Figure 10:
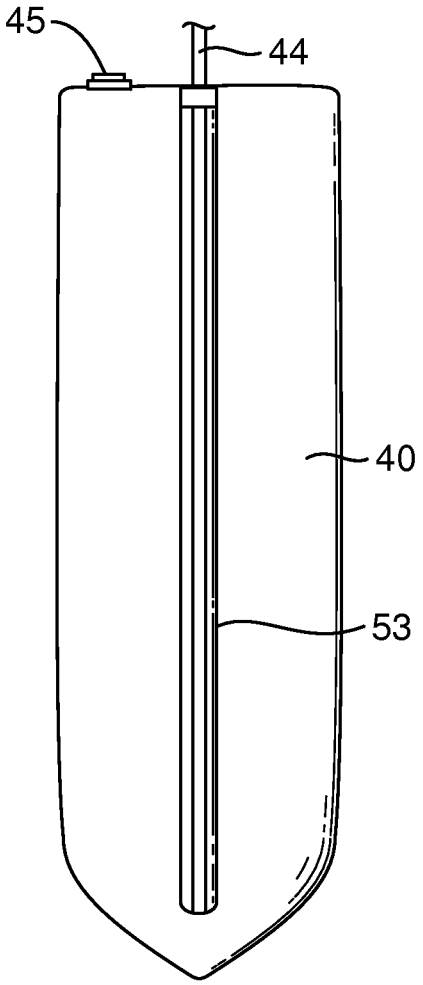
FIG. 10 illustrates a representative container comprising a tube disposed within a recess.

In some implementations (e.g., where the container 40 comprises a rigid or a semi-rigid material), the container comprises a one-way valve that opens to allow ambient air to enter the container when a user sucks fluid from the container, and that closes to prevent fluids from draining from the valve when the user stops sucking. While such a one-way valve can be disposed in any suitable location, FIG. 10 shows a representative embodiment in which the one-way valve 45 is disposed near a top end of the container 40 (as oriented when typically worn).

In some embodiments, the flexible tube 44 is connected to the container 40 through which a user can drink fluid from the container 40. While the tube can run through (or over) the apparel item 20 (e.g., necktie 22) in any suitable manner (including, without limitation, through the apparel item, through a tie string on the apparel item (e.g., a hooded item), etc.), in some instances, the flexible tube 44 is run from the container 40 within the wide end 24 of the necktie 22 into the narrow end 28 of the necktie 22. The flexible tube 44 can be run from the wide end 24 of the necktie 22 to the narrow end 28 of the necktie 22 in any suitable manner, including, without limitation, via an opening a point 34 between the wide end 24 and the narrow end 28 of the tie, up by the knot portion 21. A first end of the flexible tube 44 can be coupled to the container 40. In some configurations, the first end of the flexible tube 44 is coupled to the container 40, as shown in FIG. 5. In some configurations, the first end 47 of the flexible tube 44 extends into the container 40 (shown in FIG. 4), like a drinking straw extending into a cup.

In order to prevent the tube 44 from kinking (e.g., where it bends between the wide end 24 and the narrow end 28 of the tie), some embodiments of the apparel item 20 (e.g., necktie 22) comprise an anti-kinking mechanism. In this regard, the anti-kinking mechanism can comprise any suitable mechanism that is capable of preventing the tube from kinking (or at least reducing the ability of the tube to kink) and thereby slowing the rate at which fluid can flow through the tube. Some examples of such anti-kinking mechanisms include, but are not limited to, anti-kink coils, anti-kink tubing, anti-kink ribbing, and/or a braided material disposed on the outside, inside, or embedded with the tube; a rounded object, such as a spool, bobbin, mandrel, anti kink-clip, etc.) that prevents the tube from being bent too tightly; etc. By way of illustration, FIG. 5 shows a representative embodiment in which the tube 44 bends around a rounded anti-kink clip 41 to prevent the tube 44 from becoming kinked.

Figure 6:
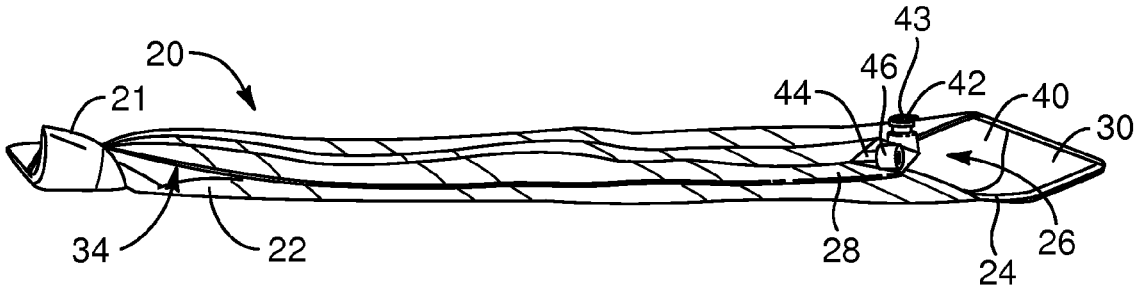
FIG. 6 illustrates a side view of a representative container inserted into an embodiment of the necktie, wherein the container is empty.
Figure 7:
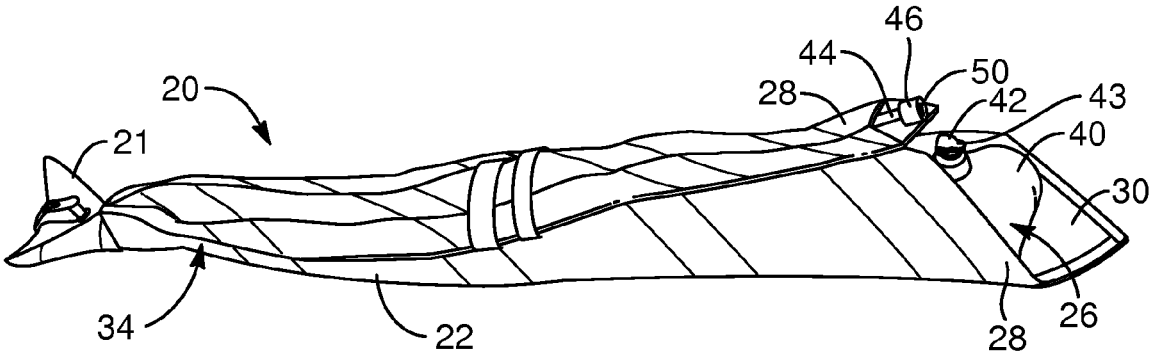
FIG. 7 illustrates a side view of a representative container in accordance with an embodiment of the present invention, wherein the container is at least partially filled.

In some embodiments, a second end 49 of the flexible tube 44 extends from the narrow end 28 of the necktie 22 (as shown in FIGS. 5 through 7). The second end of the flexible tube 44 can be open, as with a straw, or closed with a valve 46, as shown.

Where the second end 49 of the flexible tube 44 comprises a valve 46, the valve 46 can have any suitable characteristic that allows it to function as intended. In some embodiments, the valve comprises a compressible valve with a slit 50 therein that can be bitten (e.g., a conventional bite valve). In other non-limiting configurations, the valve is manually opened and closed by rotating a lever (not shown).

Figure 4:
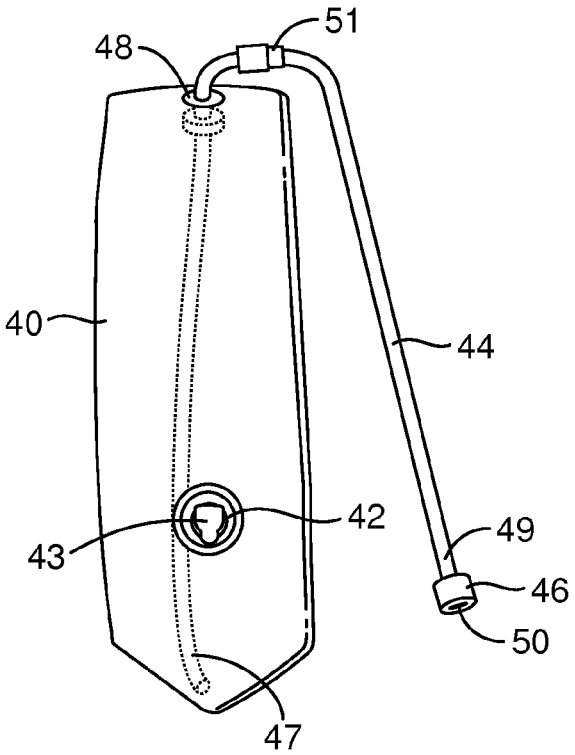
FIG. 4 illustrates a view of a representative container in accordance with an embodiment of the present invention.

The first end of the flexible tube 44 can be coupled to the top 48 (as oriented when worn) of the container 40, as shown in FIG. 4, or at the bottom of the container 40, as shown in FIG. 5. This coupling can be fluid tight to prevent leakage. The flexible tube 44 can have various lengths to extend from the container 40 to the narrow end 28 of the necktie 22 or farther than this, as may be desirable.

In some embodiments, the container 40 and the flexible tubing 44 are selectively disconnectible from and reconnectible with each other. In this manner, a user can easily remove the container from the apparel item 20 (e.g., the necktie 22). Accordingly, the user can easily wash, switch, or replace the container and/or apparel item. In such embodiments, the container and flexible tubing can be selectively connected to each other in any suitable manner, including, without limitation, through the use of a frictional engagement, a treaded coupling, a mechanical mechanism (e.g., a quick-release coupling), and/or any other suitable manner. By way of example, FIG. 4 shows a representative embodiment in which the container 40 and tube 44 are selectively attached to each other via a quick release coupling 51 comprising two components that selectively attach to and detach from each other.

FIGS. 6 and 7 illustrate representative embodiments of the apparel item 20, a necktie 22, with an empty and filled container 40 therein, respectively. In some configurations, it may be beneficial, due to the weight of water (or another fluid in the container), to vary the size of the container. The size of the container 40 can vary based on its intended use and the size of the clothing item, in order to avoid excess size which can cause jiggling of the fluid and overly heavy clothing. Indeed, in some embodiments, the container 40 holds a volume between about 0.5 and about 24 fluid ounces. In other embodiments, the container 40 holds a volume between about 1 and about 16 fluid ounces. In still other embodiments, the container 40 holds a volume between about 1.5 and about 12 fluid ounces. In specific instances, the container 40 is designed to hold relatively small amounts of fluid, as may be desirable for containing alcohol. In these instances, the volume of the container 40 can be between about 2 and about 12 fluid ounces, such as 6 ounces.

Figure 8:
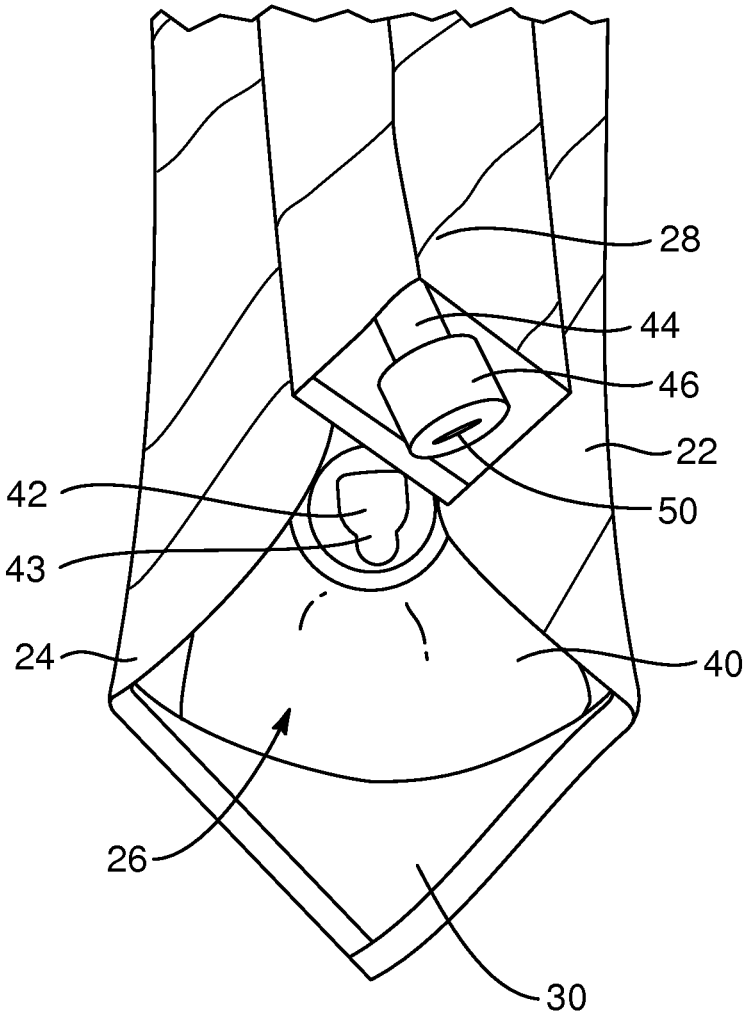
FIG. 8 illustrates a representative container inserted into the necktie, wherein the container is at least partially filled.

FIG. 8 depicts a close-up view of the internal compartment 26, the container 40, and the valve 46, according to a representative embodiment. As shown, the opening 42 of the container 40 can be disposed near the opening of the internal compartment 26 that receives and houses the container 40. In this manner, the opening can be accessed, opened, and the container can be filled without requiring the container to be removed from the internal compartment. In other embodiments, as shown in FIG. 5, the opening 42 is disposed on a top portion of the container 40 rather than on a bottom portion of the container 40 (as shown in FIG. 4). In still other embodiments, FIG. 10 shows that where the container 40 comprises a rigid and/or semi-rigid material, the flexible tube 44 extends from a bottom portion of the apparel item 20 (e.g., necktie 22, which is not shown in this Figure), through a recess 53 in the container 40, and up past the top portion of the container.

As previously mentioned, when the container 40 is flexible or semi-flexible, it can not only contain a liquid, but can also be used to contain air and be used as a pillow or other cushion. Moreover, where the container comprises a rigid or a semi-rigid material, the contents of the container can be pressurized to help fluid leave the container (e.g., when a valve, such as the bite valve 46, is opened). In any case, the container 40 can be filled with air in virtually any desired manner. For example, the container 40 can be inflated manually, mechanically, or be self-inflated. Where the container 40 is inflated manually, the container 40 can be inflated in any suitable manner. In one example, the container 40 is filled by blowing air from one's mouth through the opening 42. In another example, the container 40 is filled by blowing air through the flexible tube 44 that is connected to the container 40. In still another example, the container comprises a manual air pump.

Where the container 40 is inflated mechanically, the container 40 can be inflated in any suitable manner. In one example, the container 40 is filled through the use of an electric pump or a container filled with compressed gas (e.g., a $CO_2$ canister). In this example, any suitable pump or compressed gas container can be used to inflate the container 40, including, without limitation, a pump or container that is integrally formed with, or selectively attachable to, the container 40. Where the container 40 is adapted to be self-inflated, it can have any characteristic or component that allows it to inflate itself. In this regard, in some embodiments, the container 40 comprises an open cell container 40 that is adapted to elastically expand and pull air into the container 40 as well as to be compacted and force air from the container.

Figure 9:
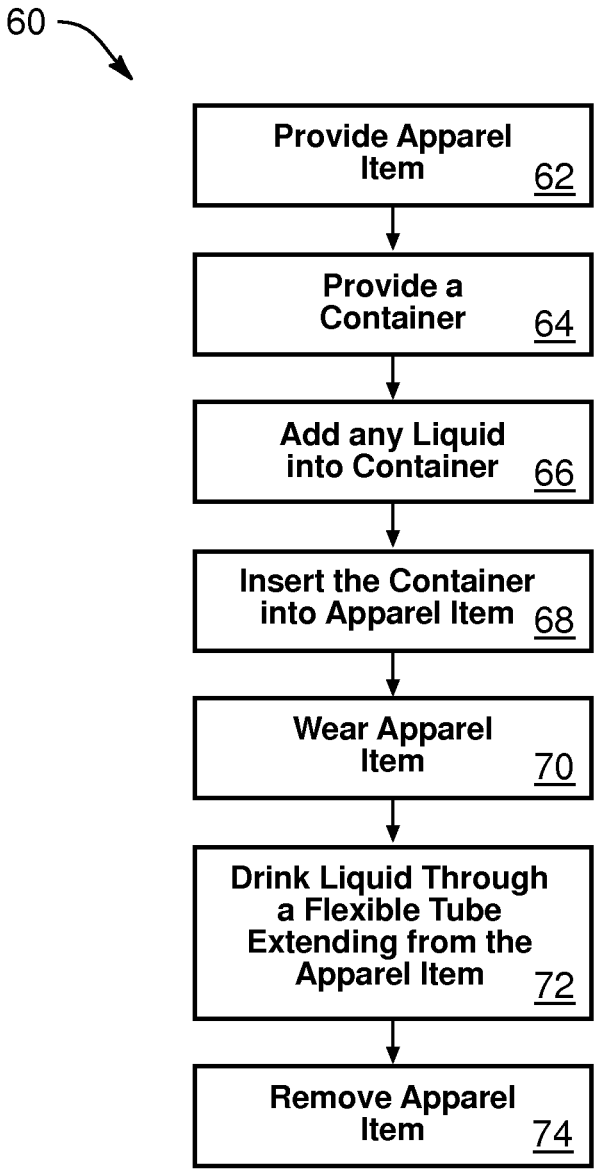
FIG. 9 illustrates a flowchart of a method for using the necktie in accordance with an embodiment of the present invention.

Although the described apparel item can be used in any suitable manner, for purposes of illustration, FIG. 9 shows a flowchart that illustrates a non-limiting example of a typical method of use. Specifically, FIG. 9 shows the method 60 begins at 62 by providing an apparel item 20, such as the necktie 22. This method continues at 64 by providing the container 40. At 66, FIG. 9 shows the container 40 can be filled with a fluid. Next, at 68, FIG. 9 shows the container is inserted into the apparel item. FIG. 9, at 70, shows that the apparel item is worn. Once the container is filled, FIG. 9 at 72 shows the fluid in the container can be consumed. FIG. 9 at 74 shows the apparel item can be removed.

In addition to the described systems, methods, characteristics, and embodiments, the apparel item 20 can be varied in any suitable manner. For example, as previously mentioned, the inflatable apparel can comprise a brazier. In this example, the brazier can comprise one or more containers, which are shaped, sized, and otherwise configured to be used in the brazier (e.g., in one or both cups). Accordingly, the brazier can have a container that is filled with fluid or inflated with air to accentuate the bust of the person wearing the brazier, to serve as a fluid container, and to serve as a cushion. In another example, the inflatable apparel can also comprise underwear with one or more corresponding containers.

Thus, as discussed herein, the embodiments of the present invention embrace apparel and accessories containing a fluid container. In particular, disclosed are systems and methods for providing apparel and/or accessories that selectively contain a fluid container that can be filled with a fluid, such as a drinkable fluid. The present invention may be embodied in other specific forms without departing from its spirit or essential characteristics. The described embodiments and examples are all to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An item of apparel comprising:

a necktie comprising a container receiving portion that selectively receives and retains a container, the container being liquid-tight;

a retaining mechanism to selectively and releasably retain the container at the container receiving portion, wherein the retaining mechanism enables selective removal of the container from the container receiving portion; and a liquid dispensing mechanism fluidly coupled to the container for selective use by a user, wherein the liquid dispensing mechanism comprises a valve.

2. The item of claim 1, wherein the liquid dispensing mechanism comprises a tube.

3. The item of claim 1, wherein the necktie includes a wide end and a narrow end, wherein the container is disposed within the container receiving portion within the wide end.

4. The item of claim 2, wherein the tube runs from the container to the narrow end of the necktie.

5. The item of claim 2, wherein the tube comprises a flexible tube.

6. The item of claim 2, wherein a first end of the tube is connected to the container and a second end of the tube has the valve to selectively seal the second end.

7. The item of claim 6, wherein the valve includes a valve opening, and wherein the valve opening comprises a slit.

8. The item of claim 1, wherein the necktie comprises a pre-tied tie.

9. The item of claim 1, wherein the retaining mechanism comprises a pocket.

10. The item of claim 1, wherein the container comprises a rigid material.

11. The item of claim 1, wherein the container comprises a flexible material.

12. The item of claim 11, wherein the retaining mechanism allows a portion of a backside of a wide end of the necktie to selectively open and close.

13. The item of claim 1, wherein the necktie comprises at least one of a clip-on mechanism and a neckband.

14. A tie comprising:

a tie configured to be worn about a user's neck, wherein the tie is selected from a necktie and a bowtie;

a container, the container being liquid-tight;

an internal compartment within the tie configured to receive and retain the container;

a tube connected to the container, the tube being exposable from the tie for selective use by the user.

15. The neckwear of claim 14, wherein the tube runs from the container to a narrow end of the neckwear.

16. The neckwear of claim 15, wherein a first end of the tube is connected to the container and a second end of the tube has a valve to selective seal and open the second end.

17. The neckwear of claim 14, wherein the tie comprises a necktie having a wide end and an narrow end, wherein the internal compartment is within the wide end and the tube runs from the container to the narrow end of the necktie.

18. A method for making a fluid-containing necktie, the method comprising:

providing a liquid-tight container;

providing a necktie having an internal compartment configured to receive and retain the container, the liquid-tight container being disposed within the internal compartment; and providing a tube having a first end connected to the container, wherein the tube is configured to selectively dispense liquid from the container.

19. The method of claim 18, further comprising running the second end of the tube through and out of a narrow end of the necktie.

20. The method of claim 18, wherein the necktie comprises a pre-tied tie having a neckband.

* * * * *